United States Patent [19]

Lehmann et al.

[11] 4,390,317

[45] Jun. 28, 1983

[54] SELF-PRIMING CENTRIFUGAL PUMP, IN PARTICULAR FOR CONVEYING LIQUIDS IN THE VICINITY OF THEIR BOILING POINT

[75] Inventors: Wilfried Lehmann, Heiligenstedten; Peter Fandrey, Gluckstadt, both of Fed. Rep. of Germany

[73] Assignee: Sihi GmbH & Co. KG, Itzehoe, Fed. Rep. of Germany

[21] Appl. No.: 288,901

[22] Filed: Jul. 31, 1981

[30] Foreign Application Priority Data

Aug. 5, 1980 [DE] Fed. Rep. of Germany ..... 3029604

[51] Int. Cl.[3] ..... F04D 9/00

[52] U.S. Cl. ..... 415/143; 415/118; 415/198.1; 415/199.1

[58] Field of Search ..... 415/1, 116, 118, 143, 415/198.1, 199.1, 219 R; 417/224

[56] References Cited

U.S. PATENT DOCUMENTS 2,553,066 5/1951 Southern ..... 415/198.1 X 3,385,225 5/1968 Hagemann ..... 415/143

4,120,618 10/1978 Klaus ..... 415/198.1X

*Primary Examiner*—Harvey C. Hornsby

*Assistant Examiner*—Arthur D. Dahlberg

*Attorney, Agent, or Firm*—Prutzman, Kalb, Chilton & Alix

[57] ABSTRACT

The invention relates to a centrifugal pump having a first centrifugal pump stage (2), which is located on the suction side and is not self-priming, and having a pump inlet nozzle (6), which is located axially at the level of the horizontal shaft (1), and having at least one centrifugal pump stage (3). which is located downstream and which, operating with the aid of auxiliary liquid, is self-priming. According to the invention, the self-priming capability and reliability of the pump, in particular for conveying media in the vicinity of their boiling point, are improved by arranging a liquid reservoir (13), of sufficient size, between two pump stages, the connection from this reservoir to the preceding centrifugal pump stage being located in the geodetically upper portion of the reservoir, and a seal (16) for closing the shaft clearance being located between the liquid reservoir (13) and the preceding centrifugal pump stage.

8 Claims, 3 Drawing Figures

Figure 1:
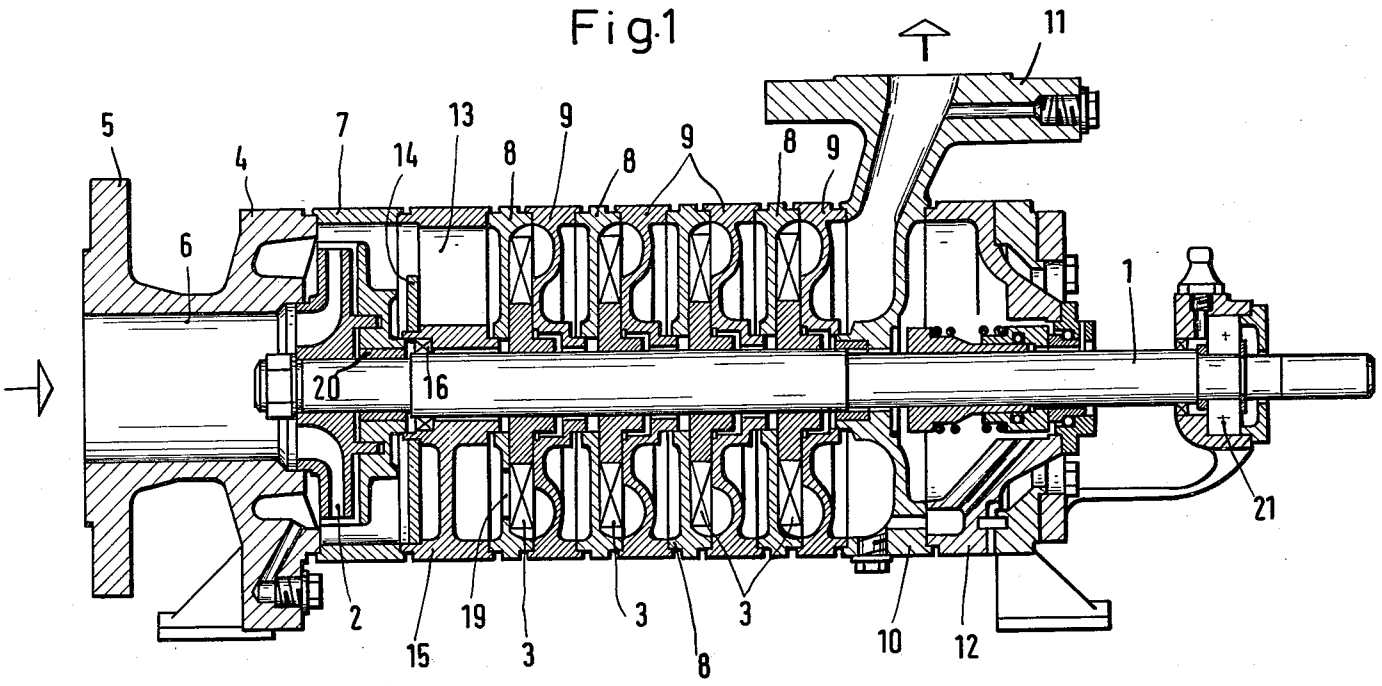

SELF-PRIMING CENTRIFUGAL PUMP, IN PARTICULAR FOR CONVEYING LIQUIDS IN THE VICINITY OF THEIR BOILING POINT

DESCRIPTION

The invention relates to a centrifugal pump having a first centrifugal pump stage, which is located on the suction side and is not self-priming, and having a pump inlet nozzle, which is located axially at the level of the shaft, and having at least one centrifugal pump stage, which is located downstream and which, operating with the aid of auxiliary liquid, is self-priming.

Pumps of this type are known, in particular for conveying media in the vicinity of their boiling point, such as, for example, liquefied gases, where flow losses of any kind must be avoided on the suction side of the pump, in order to prevent cavitation in the first pump stage. The inlet nozzle, which is located axially, at the level of the shaft, should prevent abrupt deviations of the inflowing medium inside the pump, in advance of the first stage. Starting from the inlet nozzle, the suction line to the vessel or tank which is to be pumped empty, should similarly be routed without large changes in direction, in order to keep, even here, the flow losses in the feed system as low as possible.

When these pumps were set up in a manner such that they were installed geodetically below the vessel to be emptied, as was generally the case previously, that is to say in a manner such that they could always operate with a positive feed, it was unnecessary to place any special value on the self-priming capability and reliability of these pumps. In the case of such installations it was merely necessary for the self-priming centrifugal stage, or stages, to be capable of drawing off those portions of the liquid which, under unfavourable operating conditions, become gaseous on the suction side of the pump, and of conveying them with the liquid.

However, in consequence of more rigorous safety regulations, there has recently been a common trend towards emplacing the vessels or tanks for, for example, liquefied gases, underground, and the necessity accordingly arises either of fitting an appropriately long, reliably enclosed, inaccessible and constructionally expensive submersible pump, or alternatively setting up a pump above the vessel, to operate under suction conditions, and then to design this pump with appropriate self-priming and reliability characteristics. These latest requirements are met only very inadequately by the pumps known hitherto, since, following shutting down and switching off, they generally run until they are empty as far as the lower edge of the intake nozzle, and the residual liquid which then remains in the pump is insufficient to guarantee reliable venting of the suction line, and consequently re-priming, when the pump is put into operation again. A common additional requirement relating to the conveying process, in particular of liquefied gases, is that the medium should be delivered without bubbles or gas. In the case of pumps, particularly when they have to operate as suction-pumps under difficult suction conditions, it is impossible to prevent at least partial evaporation of the medium being conveyed, in the inlet region of the pump, even if the design of these pumps is optimal with respect to the suction capability. Although some of the medium gasified in the suction line, or in the inlet region of the pump, is liquefied again as a result of the pressure rise in the pump, a gas-separator must still, however, be located downstream of such pumps, for safety reasons, in order to ensure that medium which is guaranteed to be free of bubbles and gas is delivered by the pump.

According to the invention, the lack of sufficient self-primimg capability and reliability is now eliminated by arranging a liquid reservoir of sufficient size between two pump stages, the connection from this reservoir to the preceding centrifugal pump stage being located in the geodetically upper portion of the reservoir, and a seal for closing the shaft clearance being located between the liquid reservoir and the preceding centrifugal pump stage. By this means, it is achieved that when, on stopping the pump, liquid flows back from the pressure line, through the pump and the suction line, into the tank or vessel on the suction side, sufficient liquid is retained in the pump to enable re-priming to take place when the pump is switched on again. In the built-in liquid reservoir, the liquid can of course flow down only from the geodetically upper portion, as far as the lower edge of the transfer passage to the preceding stage. Reverse flow along the shaft clearance is also prevented by the seal which is provided in this region, between the liquid reservoir and the preceding pump stage.

In a further embodiment of the concept of the invention, it is proposed to arrange the liquid reservoir between the first stage, which is not self-priming, and the first subsequent centrifugal pump stage, which is self-priming, whereby it is achieved that, in the event of the pump ceasing to operate, that is to say, in the event of the liquid flowing back from the pressure line, through the pump, into the vessel on the suction side, as large a portion of liquid as possible is retained in the pump itself, since a portion of liquid, even if only a smaller one, similarly remains in the self-priming centrifugal stages located downstream of the reservoir. On restarting the pump, this liquid is then conveyed, within a short time, into the last self-priming stage, which is known to take over the priming process by itself, and is then available to this stage as operating liquid for the priming process.

The liquid reservoir located between two pump stages can now also be utilised, according to the invention, for the additional purpose of separating gas from the liquid during the conveying process, this reservoir then being expediently located between the first centrifugal stage and the second centrifugal stage, which is self-priming, and a connection for a bleed line being provided in the region of the geodetically highest point of this liquid reservoir. Locating the liquid reservoir at this point has the advantage that a major part of the portion of liquid which has possibly been converted into gas on the suction side of the pump and in the suction line is already recondensed as a result of compression by the stage to which admission is unrestricted, and by the first self-priming stage, and only a residual portion of gasified medium is still contained in the conveying flow at the abovementioned point. This residual portion of gaseous medium can then be fed back into the tank or vessel on the suction side, via the bleed line provided at the highest point of the liquid reservoir, so that only liquid which is still free of gas is conveyed by the stages downstream of the liquid reservoir, and issues from the nozzle on the pressure side of the pump. By selecting an appropriately optimal cross-section for the line leading back from the liquid reservoir to the vessel or tank, it is even feasible to minimise a portion of liquid which may possibly be flowing back with the gas, so that the efficiency of the pump is influenced only insignificantly, or undetectably, by this effect.

In order to enhance the separating effect in the liquid reservoir, it is proposed to design this space specifically as a vessel for separating-off and removing gas from liquid, by configuring the space in an appropriate manner and by the installation of ribs. In addition, these fittings have the further advantage that they also retard the return flow of the medium in the event of the pump ceasing to operate, that is to say, when the liquid flows back, after switching-off, from the pressure line, through the pump, into the vessel on the suction side, and by this means a particularly large portion of liquid is retained in the part of the pump downstream of the liquid reservoir.

Self-priming centrifugal pump stages in the form of peripheral-passage stages have proved particularly suitable for use in a pump of this type, since they possess an optimal self-priming capability. In this case, the axial extent of the liquid reservoir should approximately correspond to the axial extent of one peripheral-passage stage, since sufficient liquid for reprimimg is thereby retained in the pump.

In order to guarantee the optimal priming capability, it is finally proposed that the intake slot of the peripheral-passage pump stage following the liquid reservoir be located in the geodetically lower region of the liquid reservoir, whereby the entire quantity of liquid stored in the reservoir is also available to the self-priming stages, as auxiliary liquid and/or operating liquid for the priming process, even in the event of restarting pump operation.

The liquid reservoir is expediently connected to a device for automatically monitoring the liquid level therein, this device generating a signal, or preventing the pump from being started, if the liquid reservoir contains an insufficient quantity of liquid. Furthermore, it can be expedient if a time-lag relay is provided, which, after switching on, switches off the pump again if priming has not taken place within a certain predetermined time interval. These precautions enable the pump to be protected from running dry.

The invention may be explained, by way of example, by reference to the attached drawings, in which:

FIG. 1 shows the longitudinal section through a 5-stage centrifugal pump, the liquid reservoir being arranged behind the first centrifugal pump stage, which is not self-priming.

Figure 2:
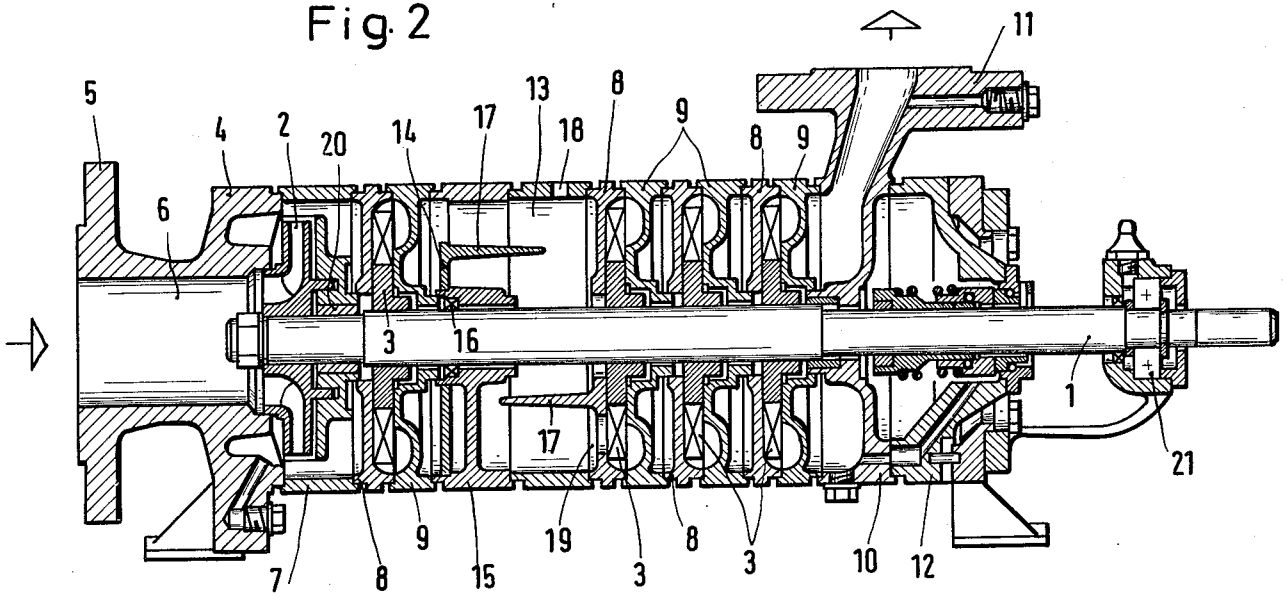

FIG. 2 similarly shows the longitudinal section through a 5-stage centrifugal pump, in which, however, the liquid reservoir is arranged behind the first self-priming centrifugal pump stage.

Figure 3:
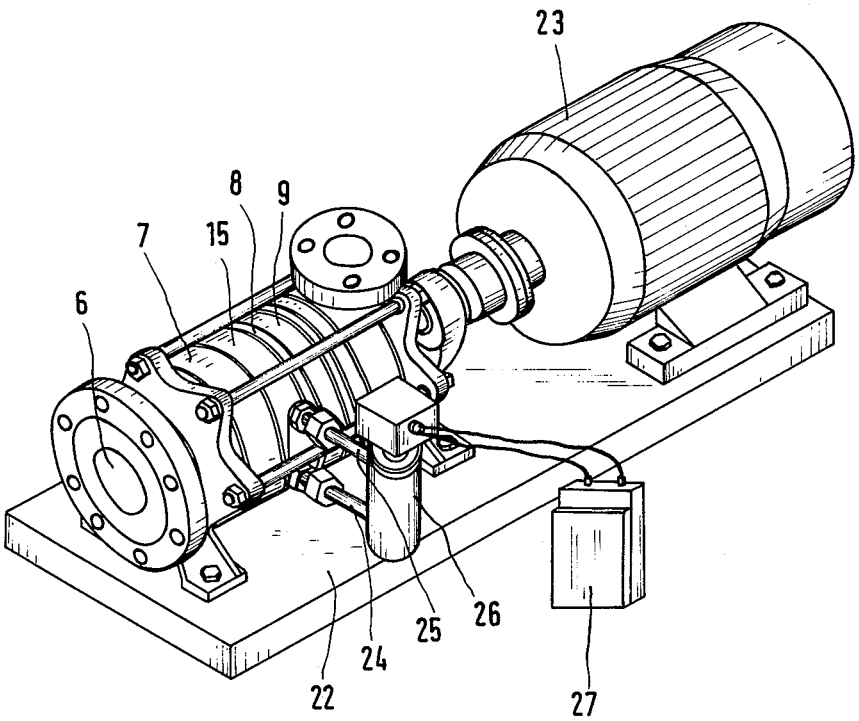

FIG. 3 shows a perspective illustration of the pump arrangement.

In the Figures, the pump shaft is marked 1, and carries, first of all, the centrifugal wheel 2 in the first pump stage, this wheel having no self-priming capability, being subjected to unrestricted admission, and being specifically designed for an optimal suction capability, that is to say, for as low an NPSH-value (net positive suction head value) of the pump as possible, without attaching particular value to efficiency and pumping-head in the case of this first wheel. The impeller wheels of the following peripheral-passage stages are marked 3. 4 is the pump inlet housing with the inlet nozzle 5 and the intake 6, which is axially located at the level of the shaft. The pump casing of the first stage, which is not self-priming, is marked 7, and the casing parts of the following peripheral-passage pump stages are marked 8 and 9. The nozzle 11 on the pressure side is located on the pump outlet housing 10. Adjoining the outlet housing 10, there also follows the housing 12 for the seal, which may be of the rotating mechanical type.

In FIG. 1, the liquid reservoir 13 is now provided behind the first centrifugal pump stage, to which admission is unrestricted, and the transfer passage from this reservoir to the first centrifugal pump stage, to which admission is unrestricted, is located in the geodetically upper region of the liquid reservoir, above the partition 14 which divides the liquid reservoir from the first centrifugal pump stage, to which admission is unrestricted. In addition, a shaft seal 16 is provided between the casing part 15, which forms the first reservoir, and the shaft 1, in the region of the shaft between this casing part and the shaft, this seal preventing a transfer of liquid into the first pump stage, in the region of the hub, from the liquid reservoir or from the pump stages located downstream.

In FIG. 2, the liquid reservoir 13 is located behind the first self-priming peripheral-passage centrifugal pump stage, and in advance of the second self-priming peripheral-passage centrifugal pump stage, the connection from the liquid reservoir to the preceding centrifugal pump stage again being effected in the geodetically upper region of the liquid reservoir and, to be precise, above the partition 14, while a shaft seal 16 is once again located between the shaft and the hub portion of the casing 15. Furthermore, ribs 17 are provided in the liquid reservoir 13, which are intended to effect a separation of the gas and the liquid in the reservoir, a further bleed aperture 18 being additionally provided at the geodetically highest point of the reservoir, for the purpose of feeding portions of gas, present in the space 13, back into the vessel or tank on the suction side, from which the pump is drawing. In both examples, the self-priming pump stages are designed as peripheral-passage centrifugal pumps, and the intake slot 19 of the peripheral-passage stage following the liquid reservoir can be recognised at the geodetically lowest point of the liquid reservoir.

It should also be mentioned that the pump shaft is mounted in a plain bearing 20 and a ball bearing 21.

In FIG. 3, the pump can be seen on the base-plate 22, with the inlet nozzle 6, the casing part 7 of the first pump stage, the casing part 15 of the liquid reservoir, and the casing parts 8 and 9 of the following self-priming stage. The pump is driven by means of an electric motor 23. An instrument 26 for determining the liquid level in the liquid reservoir is connected, via connections 24, 25, to the upper and lower parts of the casing part 15 of the liquid reservoir, the electrical energy for this instrument being supplied by a battery 27. Instruments of this type for determining the level of a liquid are known, and accordingly require no explanation here. The instrument is set so that it transmits a signal if, in the event of switching on the pump, the liquid level in the liquid reservoir lies beneath a certain limit, which must be reached if the liquid contained in the liquid reservoir is to be sufficient for the priming process. If this signal appears, either the pump motor 23 is automatically prevented from running, and/or the attention of the operator is drawn to the fact that the liquid level in the pump is inadequate, so that he can arange for it to be topped-up.

Furthermore, the instrument 26 is set up in such a way that, after the expiry of a defined time period, for example 30 seconds, after starting the pump, a check is automatically made as to whether the pump has developed suction. If the priming process has not taken place, the pump is automatically switched off.

Corresponding actions apply if the pump ceases to function during operation, that is to say, if no liquid is drawn in.

We claim:

1. Centrifugal pump having a first centrifugal pump stage, which is located on the suction side and is not self-priming, and having a pump inlet nozzle, which is located axially at the level of the horizontal shaft, and having at least one centrifugal pump stage, which is located downstream and which, operating with the aid of auxiliary liquid, is self-priming, characterised in that a liquid reservoir, of sufficient size, is arranged between two pump stages, the connection from this reservoir to the preceding centrifugal pump stage being located in the geodetically upper portion of the reservoir, and a seal for closing the shaft clearance being located between the liquid reservoir and the preceding centrifugal pump stage.

2. Centrifugal pump according to claim 1, characterised in that the liquid reservoir is arranged between the first stage, which is not self-priming, and the following first centrifugal pump stage, which is self-priming.

3. Centrifugal pump according to claim 1, characterised in that the liquid reservoir is arranged between the first self-priming stage and the second self-priming stage, and in that a connection for a bleed line is located in the region of the geodetically highest point of the liquid reservoir.

4. Centrifugal pump according to claims 1, 2 or 3, characterised in that the liquid reservoir is designed as a vessel for separating and removing gas from liquid, by configuring the said reservoir in an appropriate manner and by installing ribs.

5. Centrifugal pump according to claims 1, 2 or 3, characterised in that the self-priming centrifugal pump stages are designed as peripheral-passage stages, and the axial extent of the liquid reservoir approximately corresponds to the axial extent of a peripheral-passage stage.

6. Centrifugal pump according to claim 5, characterised in that the intake slot of the peripheral-passage pump stage downstream of the liquid reservoir is located in the geodetically lower region of the liquid reservoir.

7. Centrifugal pump according to one of claims 1, 2 or 3, characterised in that the liquid reservoir is connected to an instrument for determining the liquid level in the said reservoir, this device being set up to transmit a signal when the liquid level in the liquid reservoir falls below a predetermined height.

8. Centrifugal pump according to one of claims 1, 2 or 3, characterised in that the pump is connected to an instrument for determining the extent to which the liquid reservoir is filled with liquid, this instrument being set up to transmit a signal if the pump has not developed suction within a predetermined time interval.

* * * * *